US005373719A

United States Patent [19]

Foerster

[11] Patent Number: 5,373,719

[45] Date of Patent: Dec. 20, 1994

[54] DEVICE FOR GENERATING BENT PORTIONS IN A PIPE, PARTICULARLY FOR GENERATING A PIPE COIL

[75] Inventor: Heinz Foerster, Meerane, Germany

[73] Assignee: Rigobert Schwarze, Cologne, Germany

[21] Appl. No.: 855,365

[22] Filed: Mar. 20, 1992

[51] Int. Cl.[5] ..... B21D 7/025

[52] U.S. Cl. ..... 72/157; 72/217; 72/219; 72/307

[58] Field of Search ..... 72/217, 219, 306, 388, 72/387, 307, 157, 159

[56] References Cited

U.S. PATENT DOCUMENTS

| | | | |
|---|---|---|---|
| 2,454,290 | 11/1948 | Payne | 72/217 |
| 3,713,317 | 1/1973 | Schenck | 72/217 |
| 3,742,749 | 7/1973 | Bondarenko | 72/217 |
| 3,894,422 | 7/1975 | Peddinghaus | 72/217 |
| 4,571,974 | 2/1986 | Pollhammer | 72/217 |

*Primary Examiner*—Daniel C. Crane
*Attorney, Agent, or Firm*—Diller, Ramik, Wight

[57] ABSTRACT

A device for generating curved pipe portions (38, 40) bent alternately in opposite senses in a continuously supplied linear pipe (18), particularly for generating a pipe coil, comprises a machine table provided with two bending rolls (12, 13) having rotational axes (15, 16) extending at a fixed mutual distance and parallel to each other. The bending rolls (12, 13) have their peripheries formed with grooves for receiving the pipe (18) which are adapted to the cross-section of the pipe (18). Further, the device is provided with a bending drive. One bending roll has a rotational axis fixed in position relative to the machine table whereas the other bending roll is pivotable by said bending drive about the bending roll having the fixed rotationai axis, thereby bending a curved pipe portion (38, 40) of the pipe (18). For obtaining a particularly simple construction of the device and allow easy handling, it is provided that, in alternate fashion, a respective one of the rotational axes (15, 16) can be fixed in position while the respective other rotational axis (15, 16) can be coupled with the bending drive. The bending drive is rotatable alternately in opposite senses.

4 Claims, 4 Drawing Sheets

DEVICE FOR GENERATING BENT PORTIONS IN A PIPE, PARTICULARLY FOR GENERATING A PIPE COIL

BACKGROUND OF THE INVENTION

The invention is directed to a device for generating bent portions in a pipe, particularly for generating a pipe coil.

Bent pipes or pipe coils generated by devices designed to this purpose are used particularly in convection heating surfaces of steam generators and heat exchangers. The bent pipes or pipe coils are formed from a linear pipe corresponding in length to the stretched length of the pipe coil.

Devices of the generic type include so-called turnover bending machines wherein for alternate bending in rightward and leftward directions the entire device is pivoted by 180° each time. The provision of this pivoting movement necessitates considerable constructional measures. For this reasons, these devices have found only limited acceptance on the market.

Further, so-called turnover tables are known for use in combination with pipe bending machines suitable for bending in one bending direction only. In this case, the bent pipe coil is pivoted by 180° after each bending step. Also these known devices are impaired by extraordinary technical complexity and cause additional technical difficulties due to more elaborate user protection.

SUMMARY OF THE INVENTION

It is an object of the invention to provide a device for generating bent portions in a pipe, particularly for generating a pipe coil, which is very simple in construction and handling.

In the bending device of the invention, one rotational axis, respectively, can be fixed in position while the respective other rotational axis can be coupled with the bending drive, the bending drive being rotatable alternately in opposite senses. By the measures of the invention, it is particularly simple to perform bending alternately in opposite senses, i.e. alternately to the left and to the right, so that, depending on a given length of pipe, pipe coils of any desired length can be produced in a plane. According to the invention, a respective one of the bending rolls, namely the bending roll being held fixed in position, acts as a template, while the other, pivotable bending roll acts as a pressure roll for bending the pipe around the template. With this bending technique, the quality of the pipe in its bent portion is reliably maintained. By the type of bending provided by the invention, an almost circular pipe section is kept up also in the curved portion, being merely of slightly smaller diameter than the linear portion as a result of the deformation.

In a preferred embodiment of the invention, the bending drive to be alternately coupled to the one or the other rotational axis comprises a rotatably driven drive disk having a guide groove with a sliding block displaceably guided therein, said sliding block being selectively coupled to one of the rotational axes.

In another preferred embodiment of the invention, coupling means are provided in fixed positions relative to the machine table to be selectively coupled to the respective fixedly positioned rotational axis. By this measure, a selected rotational axis can be fixed in position with respect to the machine table and then be released again.

In still another preferred embodiment of the invention, the bending rolls are combined to form a pipe bending tool block comprising at least one coupler for carrying the bending rolls. This measure provides that the two bending rolls are integated to form one stable unit and that only the thus provided small tool block is pivoted for the bending of pipes.

The term "pipe" is meant to denote not only hollow rounded longitudinal bodies but also massive longitudinal bodies of circular section, e.g. normal round stock made from metal, e.g. wires, rods and the like although the device of the invention is particularly suited for the manufacture of pipe coils.

Further advantages, features and details of the invention will be apparent from the following description of a preferred embodiment in conjunction with the drawings.

DESCRIPTION OF THE PREFERRED EMBODIMENTS

Figure 1:
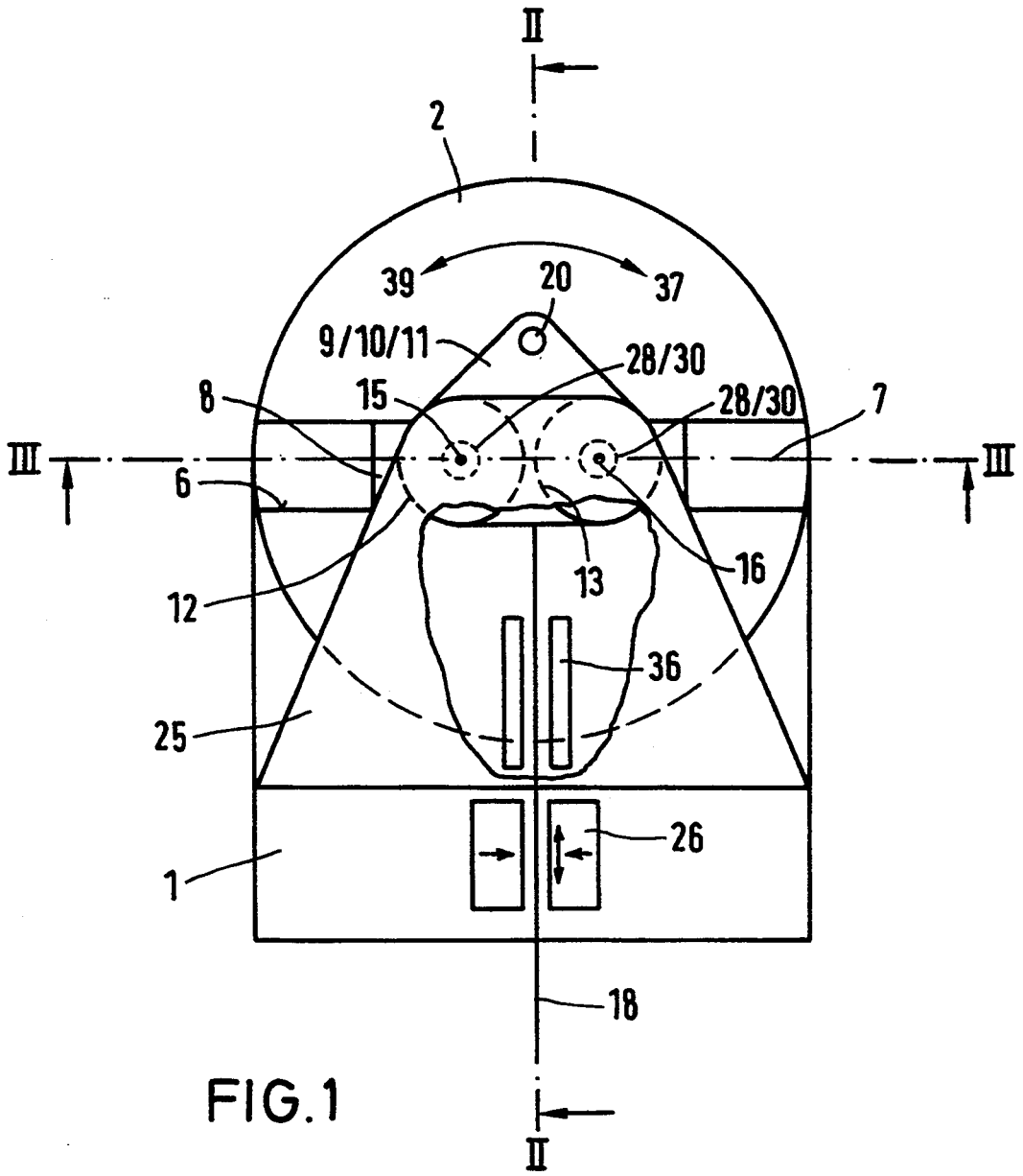
FIG. 1 a plan view onto the pipe bending device.
Figure 2:
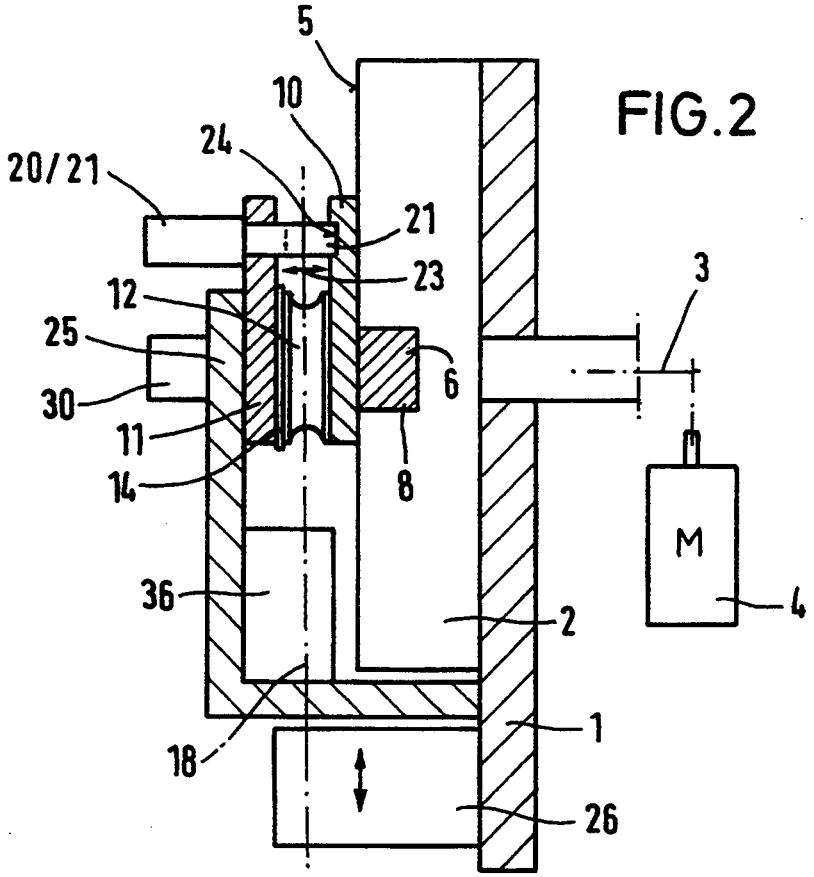
FIG. 2 is a vertical lengthwise sectional view of the device of FIG. 1 along the sectional line II—II in FIG. 1.
Figure 3:
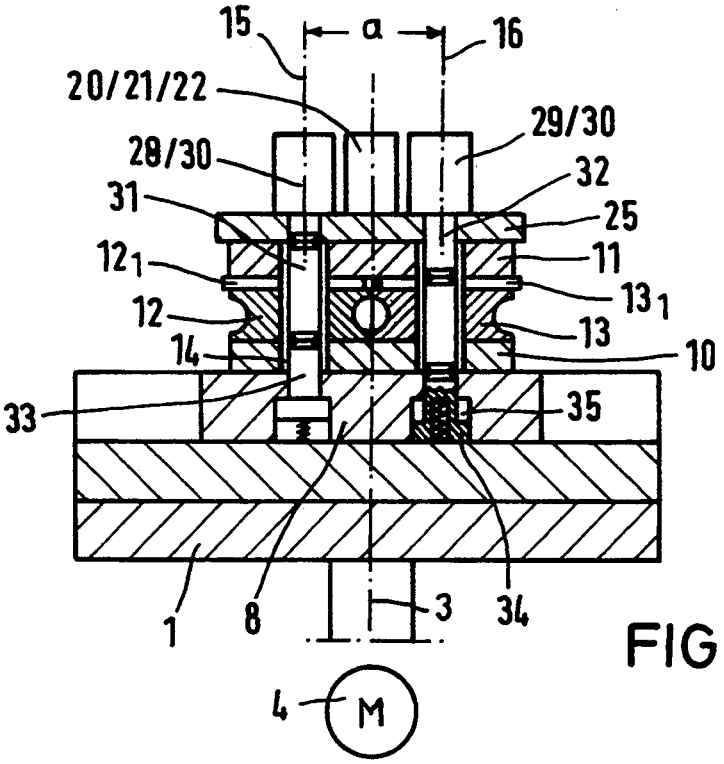
FIG. 3 is a vertical cross-sectional view of the device of FIG. 1 along the sectional line III—III in FIG. 1.
Figure 4:
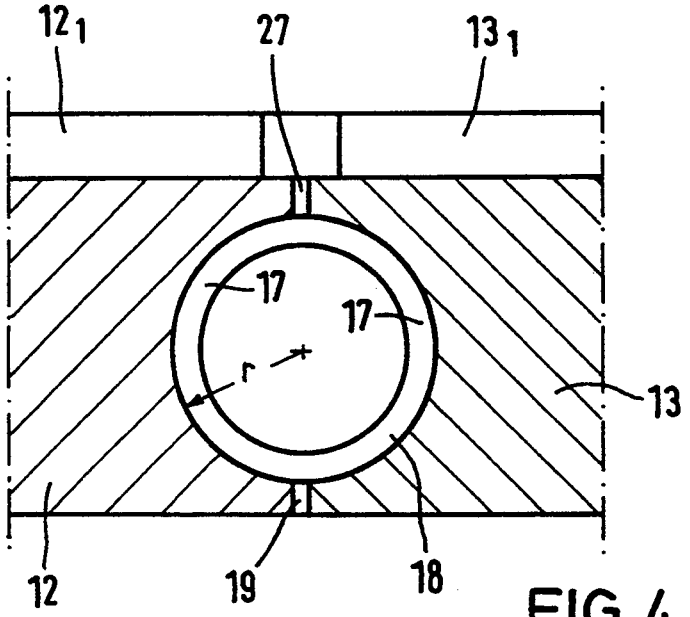
FIG. 4 is a partial view from FIG. 3 at an enlarged scale.

A device for the bending of pipes is mounted on a stationary machine table 1. The device comprises a drive disk 2 supported on machine table 1. A drive motor 4 is provided at the underside of machine table 1 for pivoting movement of drive disk 2 about the central axis 3 thereof. Drive motor 4 has either a reversing gear or is otherwise adapted for rotation in both directions so that drive disk 2 can be rotated about axis 3 in both rotational directions. A guide groove 6 is formed on the upper side 5 of drive disk 2 facing away frcm machine table 1. The central longitudinal axis 7 of guide groove 6 intersects the central axis 3 of drive disk 2 and extends at a right angle to central axis 3. Guide groove 6 accommodates a sliding block 8 being freely displaceable therein in the direction of axis 7 while being guided with minimum allowance in transverse direction thereof. Sliding block 8 is adapted to be coupled with a pipe bending tool block 9. This pipe bending tool block 9 comprises a lower coupler 10 and an upper coupler 11 consisting of substantially triangular plates having rounded edges and identical contours. Lower coupler 10 and upper coupler 11 have two bending rolls 12, 13 arranged therebetween which in the two congruently positioned couplers 10, 11 are supported by means of bearing bushes 14 for rotation about pivot pins 15, 16. The corresponding rotational axes 15, 16 extend in parallel to the central axis 3 of drive disk 2. The bending rolls 12, 13 are of identical configuration; their peripheral portions are provided respectively with a groove 17 of substantially semicircular extension and a radius slightly inferior to half the diameter of a pipe 18 destined for bending. On both sides of groove 17, the bending rolls 12, 13 have a cylindrical peripheral region 19 for mutual abutment of the bending rolls 12, 13, with a small allowance being still left between them.

For the desired rolling movement of the pressure roll against the template roll, toothed disks $12_1$ and $13_1$, respectively can be provided on the upper faces of the two rolls.

The upper coupler 11 has arranged thereon a pipe carrier 20 having a linear drive means located on upper coupler 11. Said linear drive means can be provided as a hydraulically or pneumatically operated piston-/cylinder drive 21 whose piston rod comprises a forked gripping means 22 to be inserted into the intermediate space 23 between upper and lower coupler 11, 10 and to be retracted therefrom in upward direction. Pipe carrier 20 is interposed between the two rotational axes 15, 16 in such a manner that pipe carrier 20 is arranged on the common tangent line of the mutually abutting bending rolls 12, 13. For obtaining improved stability, pipe carrier 20 can be adapted for engagement into a complementary recess 24 in lower coupler 10.

A machine bracket 25, mounted on machine table 1, partially covers the pipe bending tool block 9, namely when the device is in its starting position wherein the central longitudinal axis 7 of guide groove 6 is oriented vertically to the feed direction 26 of the pipe 18 and when sliding block 8 is in an intermediate position in guide groove 6 and when pipe bending tool block 9 is arranged in such a position that the central axis 3 of drive disk 2 extends through the contacting region 27 of bending rolls 12, 13 wherein the bending rolls 12, 13 have the common tangent line mentioned above.

Coupling means 28, 29 are mounted on bracket 25 at a distance a corresponding to the distance a of the two rotational axes 15, 16. Said coupling means 28, 29 comprise a linear drive provided as a hydraulically operated piston-/cylinder drive 30 whose respective piston rod plunger bolt 32 is in axial contact with a distance pin 31 and can be shifted into the bearing bush 14 of the respective bending roll axis in the region of upper coupler 11 or be retracted out of bearing bush 14, respectively. Thus, depending on which of two coupling means 28, 29 is actuated, the pipe bending tool block 9 is fixed in position in such a manner that either its rotational axis 15 or its rotational axis 16 is held undisplaceably relative to machine table 1 while, however, tool block 9 can be pivoted about the respective fixed axis. Spring bolts 33, 34 are arranged at a mutual distance a on sliding block 8, being adapted to push up the appertaining bearing bush 14 in the region of lower coupler 10, with the bearing bush 14 axially contacting distance pin 31. Counterbores 35 are provided in sliding block 8 for limiting the stroke of the spring bolts 33, 34. The spring bolt 33 or 34, respectively, is locked into a bearing bush 14 assigned to that rotational axis 15 or 16, respectively, which is not fixed in position by coupling means 28 or 29. In other words, one rotational axis 15 is coupled to sliding block 8 by a spring bolt 33 whereas the other rotational axis 16 is stationarily fixed to bracket 25 by coupling means 29, and vice versa.

Immediately before the pipe bending tool block 9 when viewed in feed direction 26 of pipe 18, a side guide and clamping means 36 for pipe 18 is arranged on machine bracket 25 for avoiding deviations of pipe 18 laterally to feed direction 26 during bending.

Figure 5:
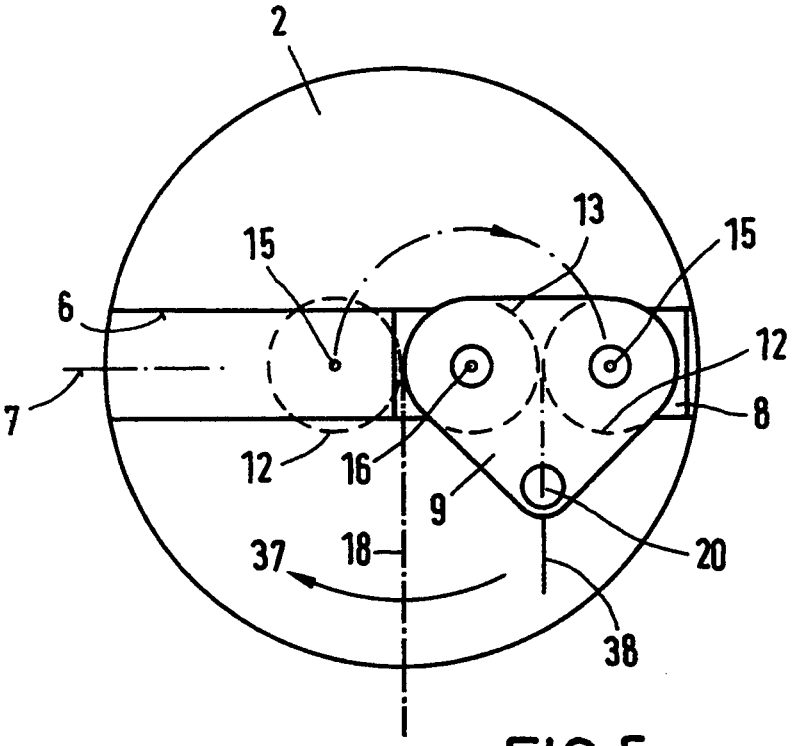
FIGS. 5 and 6 illustrate the moving sequence during rightward bending and FIG. 7 illustrates the moving sequence during leftward bending of a pipe.
Figure 6:
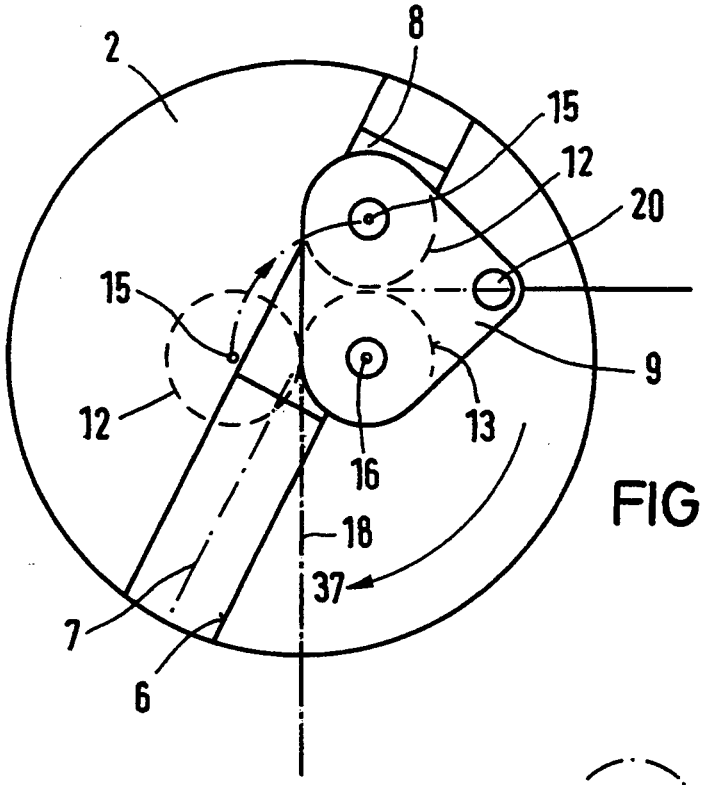
Figure 7:
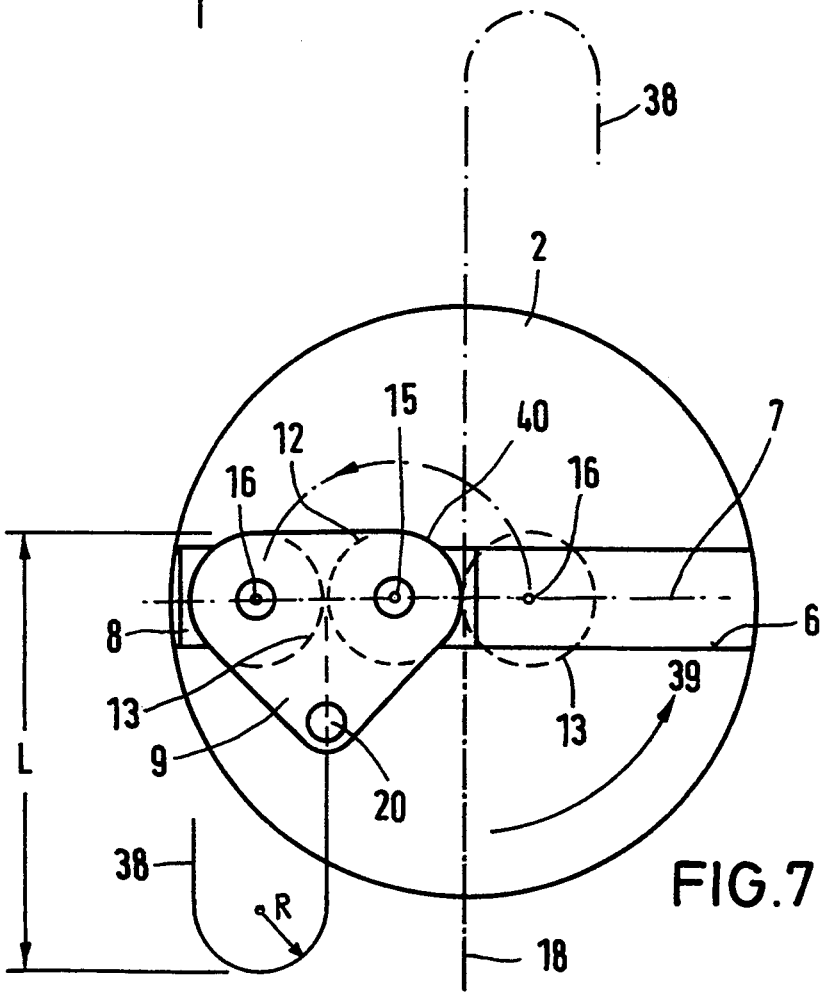

Operation of the bending device will be explained in connection with FIGS. 5 to 7. In the starting position of drive disk 2 and pipe bending tool block 9, the central longitudinal axis 7 of guide groove 6 extends vertically to the feed direction 26 for a pipe 18. A pipe 18 is pushed to pass through bending rolls 12, 13 in their contacting region 27. The two bending rolls 12, 13 in the contacting or tangent region 27 have a radius r of the bending roll groove slightly larger than half the pipe diameter. This applies both to the contacting region at the starting time of the bending and to that at the completion of the bending of the respective pipe curve of 180°. For the rightward bending shown in FIGS. 5 and 6, rotational axis 15 is connected to sliding block 8 by spring bolt 33 while the other rotational axis 16 is fixed in position on bracket 25 by coupling means 29. By suitable actuation of pipe carrier 20, pipe 18 is gripped and fixed between couplers 10, 11 by gripping means 22. Thereafter, drive disk 2 is driven by drive motor 4 in the rotational direction 37 for rightward bending, i.e. in clockwise direction. Then, tool block 9 is pivoted about rotational axis 16 arranged excentrically to central axis 3 of drive disk 2, i.e. bending roll 13 does not change its position. In this bending process, bending roll 13 has the function of a template. Bending roll 12, on the other hand, whose rotational axis 15 is fixed in position with respect to sliding block 8, is taken along by sliding block 8 due to the rotational movement of drive disk 2 and at the same time bends pipe 18 about bending roll 13 operating as a template. Thus, bending roll 13 takes over the function of a pressure roll. FIG. 6 shows an intermediate position wherein pipe 18 is bent by 90°. It is to be noted that drive disk 2 has already been pivoted by more than 90° in this constellation. The end of the bending process is shown in FIG. 5 wherein the bending roll 12 (whose starting position is indicated by interrupted lines) is shown in its extended position.

Thereafter, pipe carrier 20 is released by retraction of gripping means 22 so that pipe 18 is not fixedly connected anymore to pipe bending tool block 9. Then, drive disk 2 is pivoted back to its starting position against rotational direction 37. Subsequently, pipe 18 is further advanced in feed direction 26 so that the already curved portion 38 is brought into the position represented by interrupted lines in FIG. 7. Then, spring bolt 34 in the region of lower coupler 10 is entered by spring force into the bearing bush 14 assigned to rotational axis 16; to this effect, the right coupling means 29 pulls the piston rod plunger bolt 32 from the region of the upper coupler 11 along rotational axis 16. At the same time, coupling means 28 is entered into the bearing bush 14 assigned to rotational axis 15 so that coupling means 28 and thus bending roll 12 are fixed in position relative to machine table 1. During this process, spring bolt 34 is pushed out of bearing bush 14 by distance pin 31. Pipe carrier 20 is operated again in such a manner that the gripping means 22 holds tight the pipe coming from the contacting region 27 of bending rolls 12, 13. Then, drive disk 2 is pivoted by drive motor 4 by 180° in the rotational direction 39 for leftward bending, i.e. counterclockwise. Sliding block 8 entrains tool block 9 through spring bolt 34, with tool block 9 being pivoted about the now stationary rotational axis 15. Again, there is generated a curved portion 40 of 180°. The bent portion 38, being shown in interrupted lines in FIG. 7 prior to this second bending process, is now oriented in a position displaced by 180° thereto, which is shown in FIG. 7 as the extended position. Already in this situation, pipe 18 has been provided with a double pipe coil. After release of pipe carrier 20, drive disk 2 can again be pivoted by 180° in a direction opposite to rotational direction 39 back into its starting position. This can be followed by the next rightward bending process as described already with reference to FIGS. 5 and 6. Thus, the above device is suited for successive bending of any desired number of alternately curved portions 30, 40. The distance L of the curved portions 38, 40, i.e. the length L of a pipe coil portion, can be identical over the complete pipe coil, which, however, is not obligatory. The length L can be selected individually from one bending process to the other one.

The whole driving operation for the device can be easily automated by a process control unit serving for control of drive motor 4, coupling means 28, 29, pipe carrier 20 and—although not further described here—an optional feed means for advance of pipe 18.

I claim:

1. A pipe bending device for bending a pipe (18) in opposite directions to form oppositely bent pipe portions (38, 40) comprising a machine table (1), two bending rolls (12, 13) rotatable about respective parallel pivots (15, 16) defining axes spaced a fixed distance from each other, said bending rolls (12, 13) each having a periphery formed with a groove (17) for accommodating a pipe (18) which is to be bent, a bending drive including a rotatable drive disk (2) having a guide path (6) formed thereon, a sliding block (8) guided displaceably along said guide path (6) and carrying a pipe bending tool block (9), said pipe bending tool block (9) carrying said tool bending rolls (12, 13), and said pipe bending tool block (9) having coupling means (28, 29) for selectively immobilizing the location of said pivot pins (15, 16) of said first and second bending rolls (12, 13, respectively) with respect to said sliding block (8) whereby upon alternately immobilizing the location of said pivot pins (15, 16) alternately oppositely curved pipe portions (38, 40) can be formed in an associated pipe (18).

2. The pipe bending device as defined in claim 1 wherein said pipe bending tool block (9) comprises a lower coupler (10) and an upper coupler (11) for receiving and supporting the tool bending rolls (12, 13) in an intermediate space (23) between said upper and lower couplers (10, 11).

3. The pipe bending device as defined in claim 1 wherein said pipe bending tool block (9) supports a pipe carrier (20).

4. The pipe bending device as defined in claim 3 wherein said pipe carrier (20) includes gripping means (22) axially displaceable transversely relative to a pipe (18) and parallel to the rotational axes of said pivot pins (15, 16).

* * * * *